US011673400B2

(12) United States Patent
Moriyama

(10) Patent No.: US 11,673,400 B2
(45) Date of Patent: Jun. 13, 2023

(54) LIQUID EJECTING APPARATUS AND FILLING METHOD OF LIQUID EJECTING HEAD

(71) Applicant: SEIKO EPSON CORPORATION, Tokyo (JP)

(72) Inventor: Keita Moriyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/452,086

(22) Filed: Oct. 25, 2021

(65) Prior Publication Data

US 2022/0126591 A1 Apr. 28, 2022

(30) Foreign Application Priority Data

Oct. 28, 2020 (JP) ..... JP2020-180478

(51) Int. Cl.
*B41J 2/175* (2006.01)
*B41J 2/18* (2006.01)

(52) U.S. Cl.
CPC ..... *B41J 2/17563* (2013.01); *B41J 2/17506* (2013.01); *B41J 2/18* (2013.01)

(58) Field of Classification Search
CPC ..... B41J 2/17563; B41J 2/17506; B41J 2/17509; B41J 2/18
See application file for complete search history.

(56) References Cited

U.S. PATENT DOCUMENTS 7,449,051 B2 * 11/2008 Olsen ..... B01D 19/0031 96/197
10,703,109 B2 * 7/2020 Yamagishi ..... B41J 2/19
2020/0207109 A1 7/2020 Kanagae et al.

FOREIGN PATENT DOCUMENTS

JP 2009-248412 A 10/2009
JP 2020-104495 A 7/2020

* cited by examiner

*Primary Examiner* — Geoffrey S Mruk
(74) *Attorney, Agent, or Firm* — Workman Nydegger

(57) ABSTRACT

A liquid ejecting apparatus includes: a liquid ejecting portion; a liquid storage portion; a filter chamber including an upstream chamber and a downstream chamber divided by a filter; a supply path; a discharge path; an opening/closing valve opening/closing the discharge path; and a pump pressurizing the ink in order to make the ink flow from the liquid storage portion to the upstream chamber, wherein a filling operation of filling the upstream chamber with the ink by driving the pump so that the ink does not pass through the filter in a state in which the opening/closing valve is opened, and then closing the opening/closing valve while the ink is flowing from the liquid storage portion toward the supply path, the upstream chamber, and the discharge path by the driving of the pump is performed.

4 Claims, 10 Drawing Sheets

LIQUID EJECTING APPARATUS AND FILLING METHOD OF LIQUID EJECTING HEAD

The present application is based on, and claims priority from JP Application Serial Number 2020-180478, filed Oct. 28, 2020, the disclosure of which is hereby incorporated by reference herein in its entirety.

BACKGROUND

1. Technical Field

The present disclosure relates to a liquid ejecting apparatus and a filling method of a liquid ejecting head, and more particularly, to an ink jet recording apparatus and a filling method of an ink jet recording head that eject ink as a liquid.

2. Related Art

A liquid ejecting apparatus typified by an ink jet recording apparatus such as an ink jet printer or plotter includes a liquid ejecting head capable of ejecting a liquid such as ink stored in a cartridge or a tank as droplets. The liquid ejecting head includes a filter chamber provided with a filter and a liquid ejecting portion provided with a nozzle discharging a liquid. The ink supplied from the cartridge or the like passes through the filter of the filter chamber and is supplied to the liquid ejecting portion.

For example, in an ink jet recording head disclosed in JP-A-2020-104495, a filling operation of pumping ink from a cartridge, a tank, or the like to the ink jet recording head by a pressurizing mechanism such as a pump to fill a filter chamber with the ink is performed. In the filling operation, the ink is first filled on an upstream of a filter. Then, when a pressure of the ink exceeds a bubble point of the filter, the ink passes through the filter, such that the ink is also filled on a downstream of the filter.

When the filling operation described above is performed, bubbles existing on the upstream of the filter in the filter chamber become fine bubbles when passing through the filter, and may remain in the middle of a flow path from the filter chamber to a nozzle of a liquid ejecting portion.

Note that such a problem exists not only in the ink jet recording apparatus but also in a liquid ejecting apparatus that ejects a liquid other than the ink.

SUMMARY

According to a preferred aspect of the present disclosure, a liquid ejecting apparatus includes: a liquid ejecting portion ejecting a liquid; a liquid storage portion storing the liquid; a filter chamber including an upstream chamber and a downstream chamber divided by a filter through which the liquid passes; a supply path through which the liquid flows from the liquid storage portion to the upstream chamber; a discharge path through which the liquid flows from the upstream chamber to the liquid storage portion; an opening/closing valve opening/closing the discharge path; and a pressurizing mechanism pressurizing the liquid in order to make the liquid flow from the liquid storage portion to the upstream chamber, wherein a filling operation of filling the upstream chamber with the liquid by driving the pressurizing mechanism so that the liquid does not pass through the filter in a state in which the opening/closing valve is opened, and then closing the opening/closing valve while the liquid is flowing from the liquid storage portion toward the supply path, the upstream chamber, and the discharge path by the driving of the pressurizing mechanism is performed.

According to another preferred aspect of the present disclosure, a filling method of a liquid ejecting head including: a liquid ejecting portion ejecting a liquid; a liquid storage portion storing the liquid; a filter chamber including an upstream chamber and a downstream chamber divided by a filter through which the liquid passes; a supply path through which the liquid flows from the liquid storage portion to the upstream chamber, a discharge path through which the liquid flows from the upstream chamber to the liquid storage portion; an opening/closing valve opening/closing the discharge path; and a pressurizing mechanism pressurizing the liquid in order to make the liquid flow from the liquid storage portion to the upstream chamber, the filling method of a liquid ejecting head includes: performing a filling operation of filling the upstream chamber with the liquid by driving the pressurizing mechanism so that the liquid does not pass through the filter in a state in which the opening/closing valve is opened, and then closing the opening/closing valve while the liquid is flowing from the liquid storage portion toward the supply path, the upstream chamber, and the discharge path by the driving of the pressurizing mechanism.

DESCRIPTION OF EXEMPLARY EMBODIMENTS

First Embodiment

Figure 1:
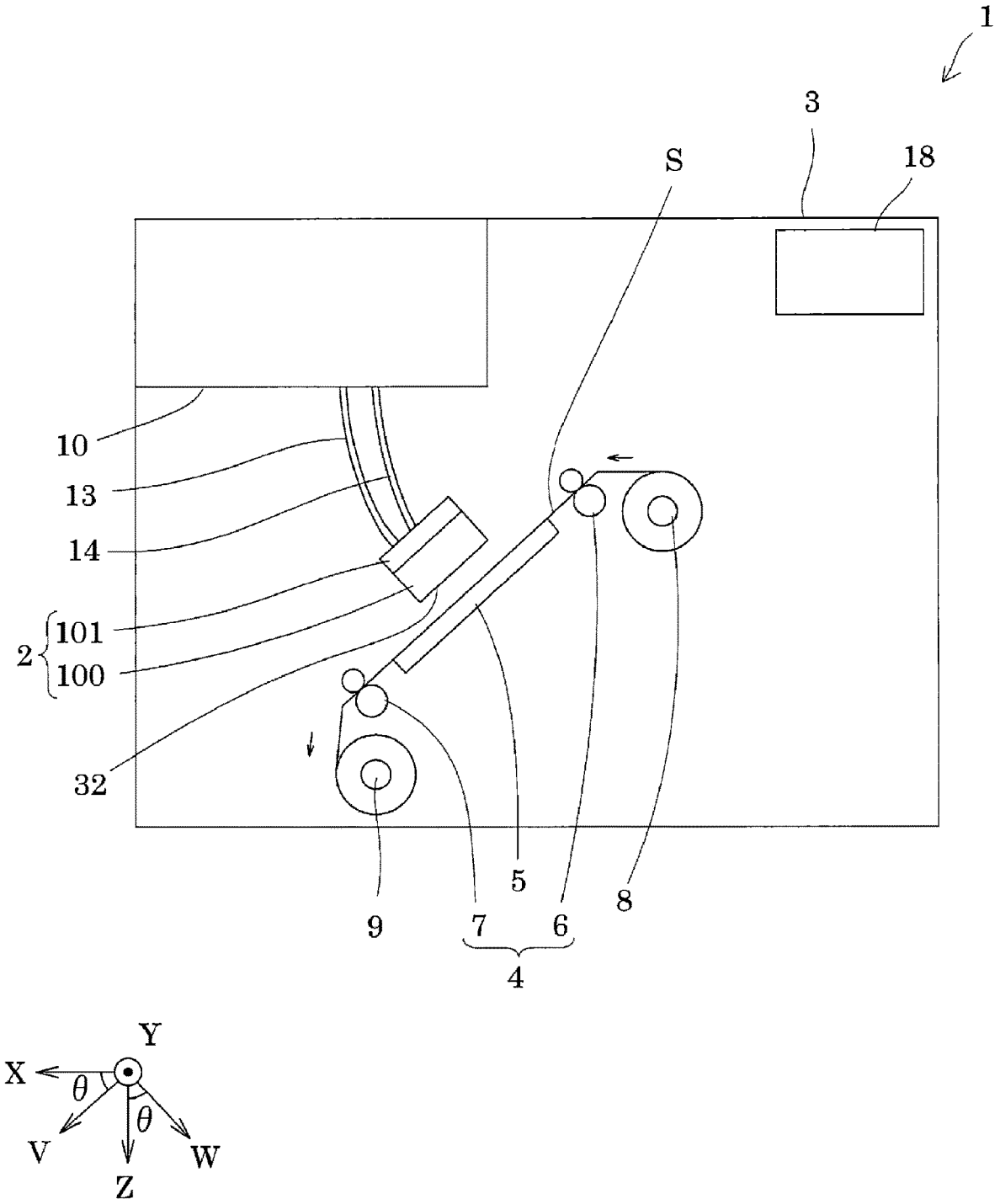
FIG. 1 is a diagram illustrating a schematic configuration of an ink jet recording apparatus according to a first embodiment.

Hereinafter, the present disclosure will be described in detail based on embodiments. However, the following description shows an aspect of the present disclosure, and can be arbitrarily changed within the scope of the present disclosure. Those having the same reference numerals in each drawing denote the same members, and a description thereof will be omitted as appropriate.

In each drawing, X, Y, and Z denote three spatial axes that are orthogonal to each other. In the present specification, directions along the X, Y, and Z axes are an X direction, a Y direction, and a Z direction. Further, an axis obtained by rotating the X axis around the Y axis by an angle θ is a V axis, an axis obtained by rotating the Z axis around the Y axis by an angle θ is a W axis, and directions along the V and W axes are a V direction and a W direction. In each drawing, directions of arrows will be described as positive (+) directions, and opposite directions to the arrows will be described as negative (−) directions. The Z direction indicates a vertical direction, a +Z direction indicates a vertically downward direction, and a −Z direction indicates a vertically upward direction.

FIG. 1 is a diagram illustrating a schematic configuration of an ink jet recording apparatus 1, which is an example of a liquid ejecting apparatus according to a first embodiment of the present disclosure.

As illustrated in FIG. 1, the ink jet recording apparatus 1 is a printing apparatus that discharges and lands ink, which is a kind of liquid, as ink droplets on a medium S such as printing paper, and prints an image or the like by an arrangement of dots formed on the medium S.

The ink jet recording apparatus 1 includes a line head 2 composed of an ink jet recording head 100 (hereinafter, also simply referred to as a recording head 100) that ejects ink, a liquid supply portion 10, a transport portion 4 that transports the medium S in a transport direction, and a support stand 5, and the line head 2, the liquid supply portion 10, the transport portion 4, and the support stand 5 are housed in a housing 3.

The line head 2 includes the recording head 100 and a holding portion 101 that holds the recording head 100. The number of recording heads 100 held by the holding portion 101 may be one or may be plural. The holding portion 101 holds the recording head 100 so that a filter, to be described later, of the recording head 100 is inclined with respect to an XY plane, which is a horizontal plane.

The line head 2 holds the recording head 100 so that an ejection direction of the ink droplet is a +W direction inclined by rotating a +Z direction, which is a vertical direction (also referred to as a gravity direction), around the Y axis. In other words, the ejection direction of the ink droplet ejected from a nozzle is the +W direction inclined in the −X direction with respect to the +Z direction. Note that an inclination angle θ of the recording head 100 constituting the line head 2 with respect to the +Z direction, that is, an inclination angle θ of the W direction, which is the ejection direction of the ink droplet, with respect to the +Z direction is set within the range of, for example, $0<\theta\leq180°$. When θ exceeds 90°, a component in a −Z direction is included in the ejection direction of the ink droplet.

Note that in the present embodiment, the recording head 100 of the line head 2 is held in a state in which it is always inclined with respect to the horizontal plane by the holding portion 101, but the recording head 100 does not need to be held in a state in which it is always inclined. For example, the recording head 100 may be held in an inclined state only in a maintenance operation such as suction cleaning or at the time of printing in which the ink is ejected onto the medium S by providing an adjustment mechanism adjusting the inclination of the line head 2 with respect to the horizontal plane.

The medium S according to the present embodiment is a kind of medium made of, for example, recording paper such as continuous paper, cloth, a resin film, or the like, and is held in a state in which it is wound around a feeding shaft 8 in a roll shape. This medium S is transported on the support stand 5 such as a platen arranged to be spaced apart from a nozzle surface of the recording head 100 on which the nozzle is formed, by the transport portion 4, and printing is performed by the line head 2 on the support stand 5. The medium S printed by the recording head 100 on the support stand 5 is configured to be wound around a winding shaft 9 by the transport portion 4.

A mounting surface of the support stand 5 on which the medium S is mounted is arranged so as to be inclined according to an inclination angle of the nozzle surface of the recording head 100. That is, an inclination angle θ between the nozzle surface and the support stand 5 is set so that an interval between each nozzle on the nozzle surface and the medium S becomes constant at the time of a printing operation. In other words, the mounting surface of the support stand 5 is parallel to a VY plane defined by the V axis and the Y axis, and an angle between the mounting surface of the support stand 5 and the XY plane is the inclination angle θ. The V direction is a direction orthogonal to the W direction and is a direction orthogonal to the Y direction. The medium S is transported in a +V direction or a −V direction by the transport portion 4 on the mounting surface of the support stand 5. Hereinafter, the +V direction or the −V direction is also referred to as a transport direction.

The line head 2 including the recording head 100 includes a large number of nozzles arranged so that the Y direction orthogonal to the transport direction of the medium S is a longitudinal direction and a printing range in the Y direction is equal to or larger than a printing range of the medium S in the Y direction. That is, the line head 2 according to the present embodiment is fixed to the housing 3 so as not to move along the Y axis during the printing operation.

Note that the medium S is not limited to the continuous paper, and various media to be ejected on which the ink droplets ejected from the nozzle of the recording head 100 can be landed can be adopted as the medium S. For example, the present disclosure can also be applied to an application in which the ink droplets are ejected on a medium to be ejected having a three-dimensional shape. Further, the support stand 5 is not limited to the platen of which a mounting surface on which the medium S is mounted is planar, and may be a so-called drum platen such as a drum of which a mounting surface on which the medium S is mounted is curved. Further, a back surface side of the medium S may be supported by a transport belt such as an endless belt.

The transport portion 4 includes a paper feeding roller 6 and a transport roller 7. The paper feeding roller 6 includes a pair of upper and lower rollers that can rotate synchronously in opposite directions in a state of pinching the medium S. The paper feeding roller 6 is driven by power of a motor (not illustrated) to supply the medium S from the feeding shaft 8 side to the support stand 5 side. The transport roller 7 is arranged on a side opposite to the paper feeding roller 6 with the support stand 5 interposed therebetween, and guides the printed medium S to the winding shaft 9 side. Note that the medium S may not necessarily be wound around the winding shaft 9. Further, it has been exemplified in the present embodiment that the transport portion 4 includes the paper feeding roller 6 and the transport roller 7, but the present disclosure is not particularly limited thereto, and the medium S may be transported by a belt or a drum.

Figure 2:
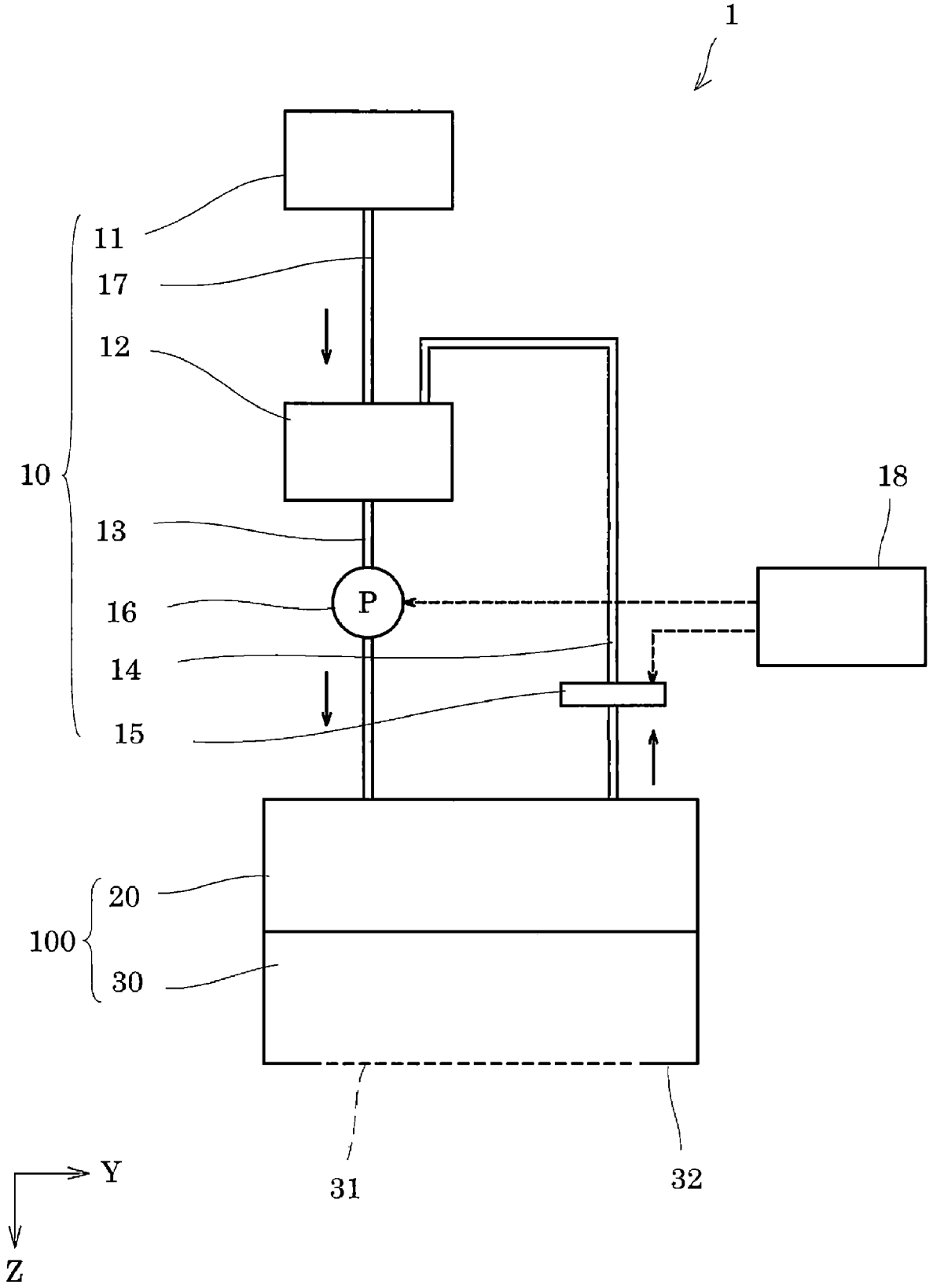
FIG. 2 is a schematic configuration diagram of a liquid supply portion and a recording head according to the first embodiment.

The liquid supply portion 10 and the recording head 100 will be described with reference to FIG. 2. FIG. 2 is a schematic configuration diagram of the liquid supply portion 10 and the recording head 100. Note that in FIG. 2, in relation to the line head 2, only the recording head 100 is illustrated, and the holding portion 101 is not illustrated.

The liquid supply portion 10 is a mechanism for supplying the ink to the recording head 100, and includes a main tank 11, an intermediate tank 12, a supply path 13, a discharge path 14, an opening/closing valve 15, a pump 16, and an inter-tank supply path 17.

The main tank 11 is a container that stores the ink, and supplies the ink to the intermediate tank 12. Specifically, the main tank 11 and the intermediate tank 12 are coupled to each other by the inter-tank supply path 17. Further, a pump (not illustrated) is provided in the middle of the inter-tank supply path 17. With such a configuration, the ink is supplied from the main tank 11 to the intermediate tank 12 via the inter-tank supply path 17 by the pump (not illustrated).

Note that a timing when the ink is supplied from the main tank 11 to the intermediate tank 12 is not particularly limited. For example, when a liquid level of the ink stored in the intermediate tank 12 becomes lower than a predetermined height or when an amount of ink becomes less than a predetermined amount, the ink is supplied from the main tank 11 to the intermediate tank 12.

The intermediate tank 12 is an example of a liquid storage portion that stores the ink. The intermediate tank 12 stores the ink supplied from the main tank 11. The intermediate tank 12 and the recording head 100 are coupled to each other by the supply path 13 and the discharge path 14.

The supply path 13 is a flow path through which the ink flows from the intermediate tank 12 to an upstream chamber 50A to be described later. The discharge path 14 is a flow path through which the ink flows from an upstream chamber 50A to be described later to the intermediate tank 12. In the present embodiment, the number of each of supply paths 13 and discharge paths 14 is one, but the number of each of supply paths 13 and discharge paths 14 is not limited.

The opening/closing valve 15 is a device that opens/closes the discharge path 14. A specific configuration of the opening/closing valve 15 is not particularly limited, and a valve such as an electromagnetic valve or a pressure valve can be used as the opening/closing valve 15. Further, the opening/closing valve 15 can be opened/closed by a control portion 18 to be described later.

The pump 16 is an example of a pressurizing mechanism that pressurizes the ink in order to make the ink stored in the intermediate tank 12 flow to the recording head 100. Specifically, a tube pump, a diaphragm pump, or the like is provided in the supply path 13 as the pump 16. Further, the pump 16 can be started and stopped by a control portion 18 to be described later.

Note that the pressurizing mechanism is not limited to the pump 16, and may be, for example, a pressurizing unit that pressurizes the ink stored in the intermediate tank 12 by pressing the intermediate tank 12 from the outside. Alternatively, a device that uses a head pressure difference generated by adjusting relative positions of the recording head 100 and the intermediate tank 12 in the vertical direction may be used as the pressurizing mechanism. Further, a configuration in which the pump 16 is provided in the middle of the supply path 13 has been exemplified, but the present disclosure is not limited thereto. For example, the pump 16 may be provided in the intermediate tank 12.

The recording head 100 includes a filter member 20 and a liquid ejecting portion 30.

The liquid ejecting portion 30 has a nozzle surface 32 provided with a nozzle 31 ejecting the ink. In the present embodiment, a nozzle row in which a plurality of nozzles 31 are provided in parallel in the Y direction is formed on the nozzle surface 32. The number of nozzle rows is not particularly limited. Further, a configuration in which the recording head 100 includes one liquid ejecting portion 30 has been exemplified, but the present disclosure is not limited thereto, and the recording head 100 may include a plurality of liquid ejecting portions 30.

Further, a flow path communicating with the nozzle 31, a pressure generating unit generating a change in pressure in the ink in the flow path, and the like, are provided in an inner portion (not illustrated) of the liquid ejecting portion 30. As the pressure generating unit, for example, a unit that discharges the ink droplets from the nozzle 31 by changing a volume of a liquid flow path by deformation of a piezoelectric actuator having a piezoelectric material exhibiting an electromechanical conversion function to generate a change in pressure in the ink in the liquid flow path, a unit that discharges the ink droplets from the nozzle 31 by bubbles generated due to heat generated by a heat generating element arranged in a flow path, a so-called electrostatic actuator that discharges the ink droplets from the nozzle 31 by generating an electrostatic force between a diaphragm and an electrode and deforming the diaphragm by the electrostatic force, or the like, can be used.

Figure 3:
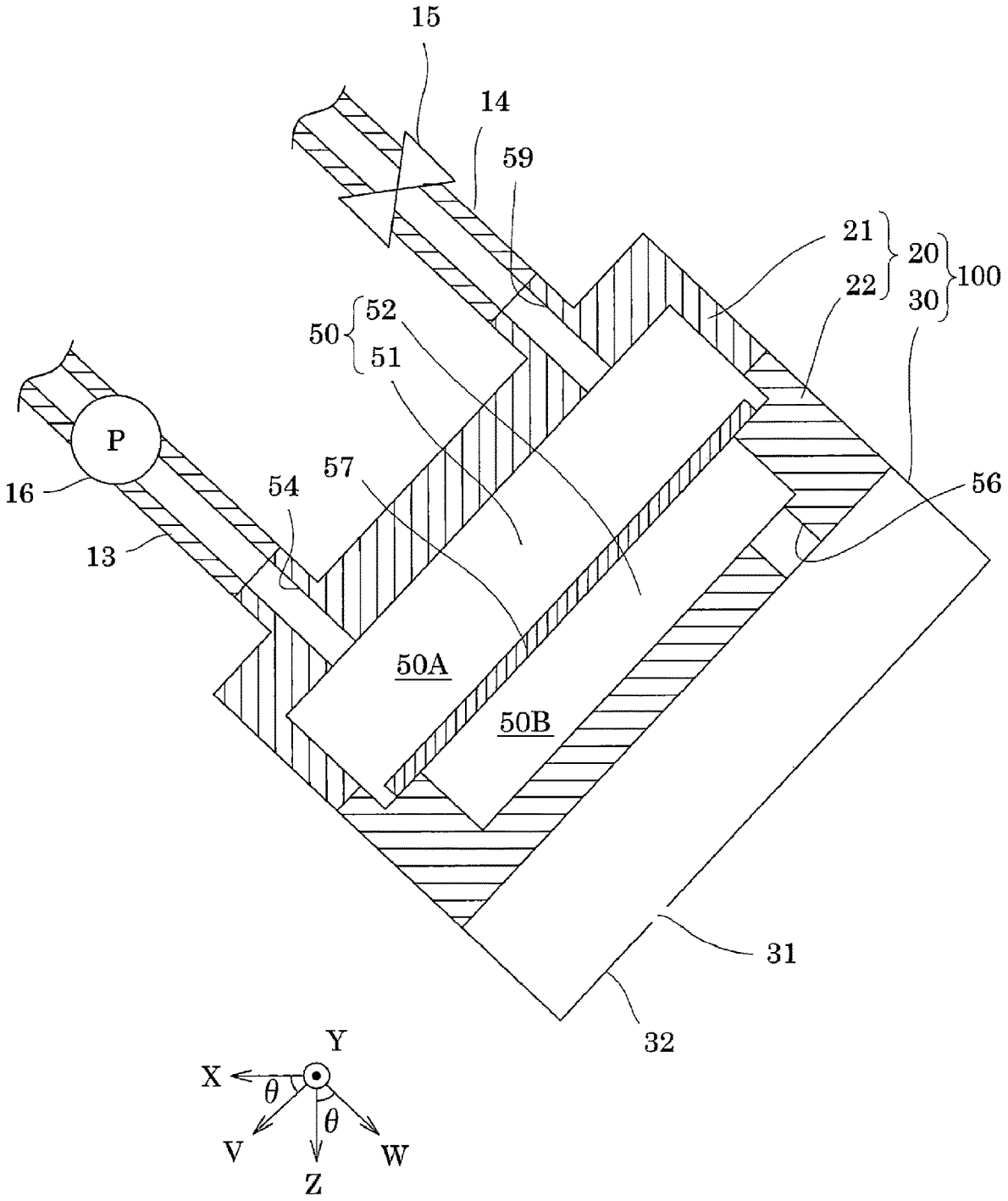
FIG. 3 is a cross-sectional view of the recording head according to the first embodiment.

The filter member 20 according to the present embodiment will be described with reference to FIG. 3. FIG. 3 is a cross-sectional view of the recording head, and illustrates the recording head 100 in a state in which the recording head 100 is arranged so that the ejection direction of the ink is the +W direction, similar to FIG. 1.

The filter member 20 has a filter chamber 50 formed in an inner portion thereof by stacking a first filter member 21 and a second filter member 22. Specifically, the filter member 20 includes the first filter member 21 provided on the holding portion 101 side (not illustrated) (the −W direction side illustrated in FIG. 3) and the second filter member 22 provided on the liquid ejecting portion 30 side (the +W direction side illustrated in FIG. 3) of the first filter member 21, and the first filter member 21 and the second filter member 22 are stacked. The first filter member 21 and the second filter member 22 can be formed of, for example, a resin material, but a material of the first filter member 21 and the second filter member 22 is not particularly limited to the resin material.

The first filter member 21 has a first recess portion 51 formed in a surface thereof on the second filter member 22 side (the +W direction side illustrated in FIG. 3). An inlet 54 and a discharge port 59, which are through holes penetrating through the first filter member 21 in the W direction, are formed on the holding portion 101 side (not illustrated) (the −W direction side illustrated in FIG. 3) of the first filter member 21. The discharge port 59 is positioned above the inlet 54 in the Z direction, which is the vertical direction.

The second filter member 22 has a second recess portion 52 formed in a surface thereof on the first filter member 21 side (the −W direction side illustrated in FIG. 3). An outlet 56, which is a through hole penetrating through the second filter member 22 in the W direction, is formed on the liquid ejecting portion 30 side (not illustrated) (the +W direction side illustrated in FIG. 3) of the second filter member 22. The outlet 56 is coupled to a flow path (not illustrated) provided inside the liquid ejecting portion 30.

The filter chamber 50 includes an upstream chamber 50A and a downstream chamber 50B divided by a filter 57 through which the ink passes. In the present embodiment, the first filter member 21 and the second filter member 22 are stacked to form the filter chamber 50 composed of the first recess portion 51 and the second recess portion 52. Then, the filter 57 is provided so as to cover an opening of the second recess portion 52. The filter chamber 50 is divided into the upstream chamber 50A and the downstream chamber 50B by such a filter 57.

The upstream chamber 50A is a space on an upstream of the filter 57 in the filter chamber 50, and the downstream chamber 50B is a space on a downstream of the filter 57 in the filter chamber 50. The space on the upstream of the filter 57 refers to a space relatively far from the nozzle 31 ejecting the ink, of two spaces divided by the filter 57 in the filter chamber 50, and the space on the downstream of the filter 57 refers to a space relatively close to the nozzle 31, of the two spaces.

The filter 57 captures foreign matters, bubbles, or the like contained in the ink, and is fixed to the second filter member 22 by heat welding, an adhesive, or the like in the present embodiment. Further, examples of the filter 57 can include a twilled linear metal, a flat plate member made of SUS and provided with a large number of holes, a non-woven fabric, or the like.

Further, a flow path resistance of the filter 57 is larger than an entire flow path resistance of the discharge path 14. The flow path resistance of the discharge path 14 mentioned here is a flow path resistance from the discharge port 59 of the upstream chamber 50A to the intermediate tank 12.

In the filter member 20 configured as described above, the supply path 13 is coupled to the inlet 54, and the discharge path 14 is coupled to the discharge port 59, such that the ink flows as follows. The ink is supplied from the intermediate tank 12 to the upstream chamber 50A of the filter chamber 50 via the supply path 13 and the inlet 54. Further, the ink that has not passed through the filter 57 is discharged from the upstream chamber 50A of the filter chamber 50 to the intermediate tank 12 via the discharge port 59 and the discharge path 14. Further, the ink supplied from the upstream chamber 50A to the downstream chamber 50B through the filter 57 is supplied to the liquid ejecting portion 30 via the outlet 56.

Further, the ink jet recording apparatus 1 described above has a configuration in which one liquid supply portion 10 including the main tank 11, the inter-tank supply path 17, the intermediate tank 12, the supply path 13, the discharge path 14, the opening/closing valve 15, and the pump 16 is provided for one recording head 100, but is not limited to having such a configuration. The ink jet recording apparatus 1 may be configured so that the ink is supplied from a plurality of liquid supply portions 10 to one recording head 100. For example, the ink jet recording apparatus 1 has a configuration in which it includes a plurality of liquid supply portions 10 each supplying a plurality of types of ink having different colors. Then, the ink jet recording apparatus 1 is configured so that a plurality of filter chambers 50 are provided in the recording head 100 and the ink is supplied from each liquid supply portion 10 to each filter chamber 50.

Further, the ink jet recording apparatus 1 described above has a configuration in which it includes the line head 2 having one recording head 100, but is not limited to having such a configuration, and may include a plurality of recording heads 100. In this case, it is sufficient that the ink jet recording apparatus 1 is configured so that the ink is distributed from one liquid supply portion 10 to each recording head 100 or the ink is distributed from each of a plurality of liquid supply portions 10 to each recording head 100.

For example, a flow path is provided in the holding portion 101 that holds the plurality of recording heads 100, and the flow path is branched by the number of recording heads 100 in the middle thereof. Then, the ink jet recording apparatus 1 is configured so that the ink supplied from the liquid supply portion 10 is supplied to the upstream chamber 50A of each recording head 100 via the flow path provided in the holding portion 101. Alternatively, the ink jet recording apparatus 1 may be configured so that the ink is distributed from the intermediate tank 12 to each recording head 100 by coupling the intermediate tank 12 and each recording head 100 to each other by the supply path 13 and the discharge path 14, respectively.

Further, the ink jet recording apparatus 1 described above has a configuration in which one recording head 100 is provided with one liquid ejecting portion 30, but is not limited thereto, and the number of liquid ejecting portions 30 may be two or more. In this case, it is possible to supply the ink from the downstream chamber 50B to each liquid ejecting portion 30 via a branch flow path using, for example, the branch flow path that communicates with the outlet 56 and branches by the number of liquid ejecting portions 30 in the middle.

The ink jet recording apparatus 1 according to the present embodiment includes a control portion 18. The control portion 18 includes, for example, a control device such as a central processing unit (CPU) or a field programmable gate array (FPGA) and a storage device such as a semiconductor memory. The control portion 18 generally controls the transport portion 4, the liquid supply portion 10, the recording head 100, and the like, of the ink jet recording apparatus 1 by executing a program stored in the storage device by the control device.

The control portion 18 executes a filling operation of the ink by controlling the opening/closing valve 15 and the pump 16. The filling operation refers to an operation of filling a flow path of the ink of the filter chamber 50 and the recording head 100 with the ink in a state in which the ink is not filled in the flow path. The filling operation is performed, for example, when the ink jet recording apparatus 1 is used for the first time. Alternatively, the filling operation is performed after the ink in the flow path of the ink of the filter chamber 50 and the recording head 100 is entirely discharged by maintenance, cleaning, or the like of the ink jet recording apparatus 1 or the recording head 100.

Figure 7:
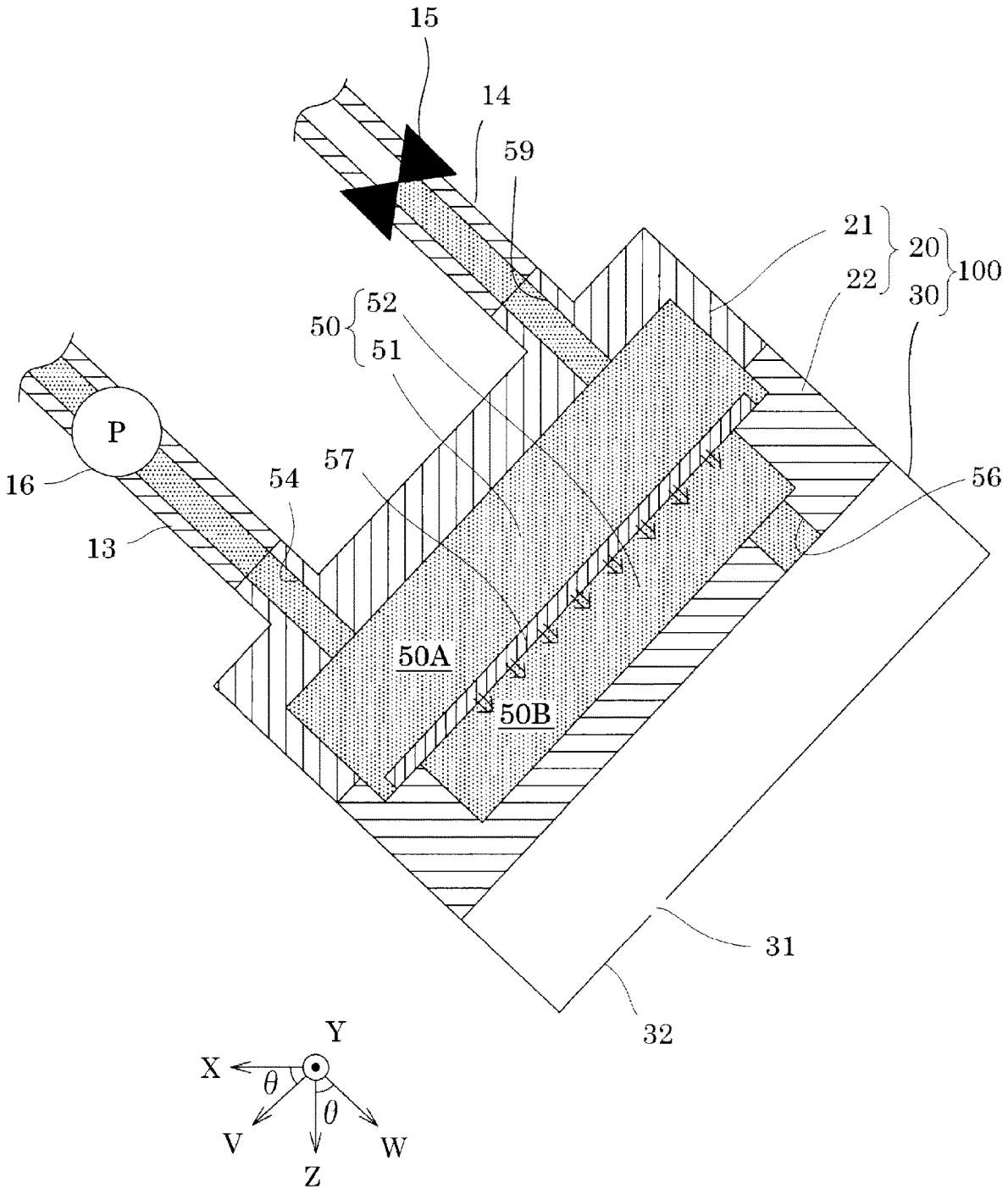
FIG. 7 is a cross-sectional view of the recording head when the filling operation according to the first embodiment is performed.
Figure 8:
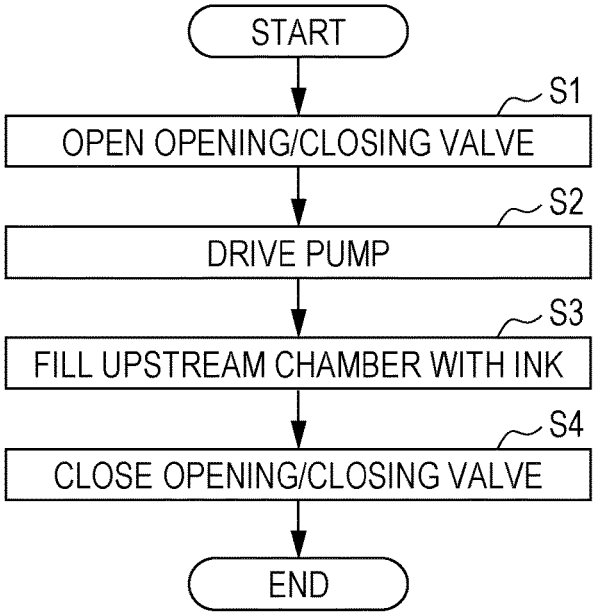
FIG. 8 is a flowchart of the filling operation according to the first embodiment.

A filling operation and a filling method of the recording head 100 by the control portion will be described in detail with reference to FIGS. 4 to 9. FIGS. 4 to 7 are cross-sectional views of the recording head when the filling operation is performed, and the recording head is arranged so that the ejection direction of the ink is the +W direction, similar to FIG. 3. Further, FIG. 8 is a flowchart of the filling operation. Note that in FIGS. 4 to 7, a white opening/closing valve 15 represents an opened state, and a black opening/closing valve 15 represents a closed state.

Figure 4:
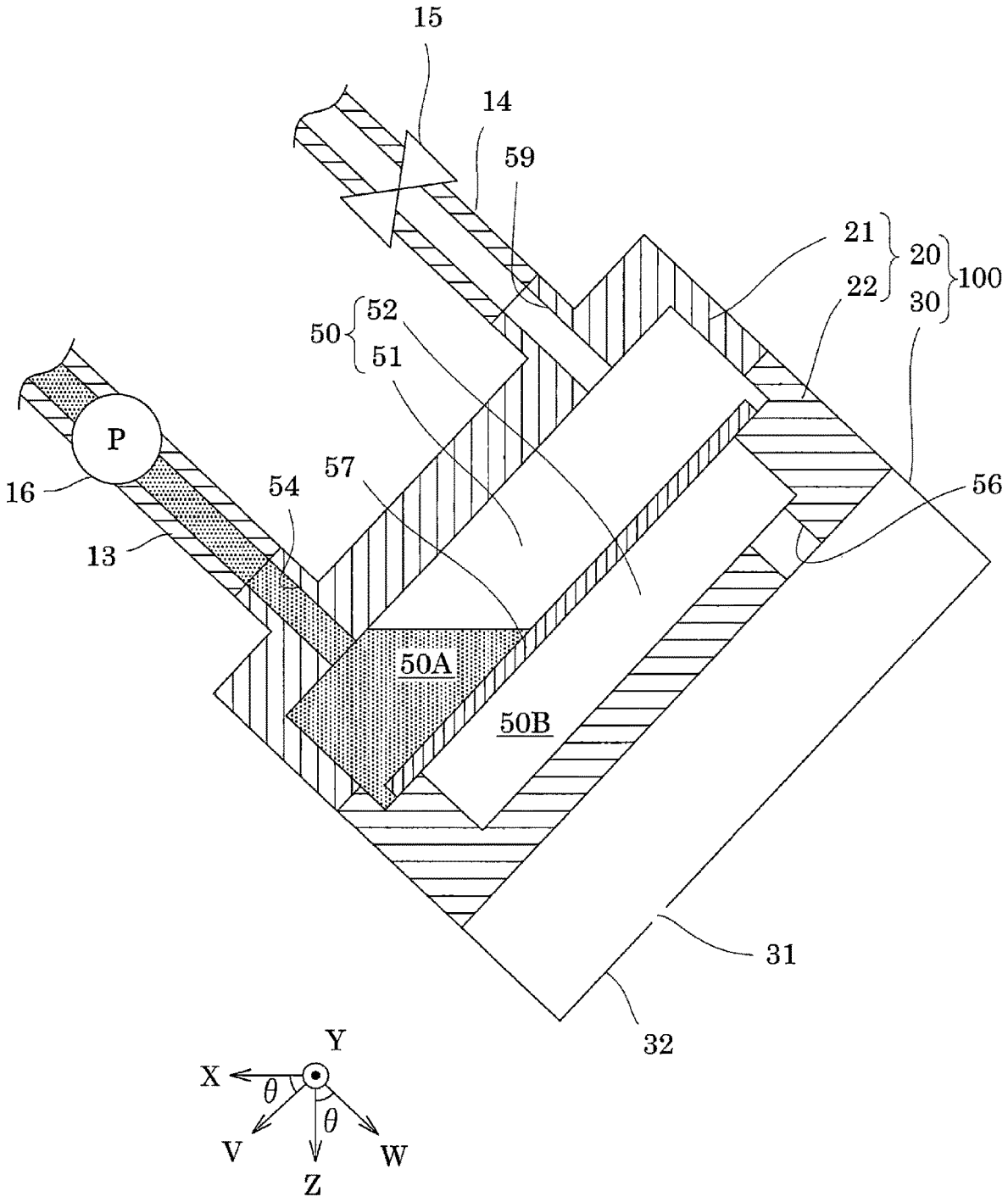
FIG. 4 is a cross-sectional view of the recording head when a filling operation according to the first embodiment is performed.

As illustrated in FIG. 4, the control portion 18 opens the opening/closing valve 15 (step S1 in FIG. 8), and drives the pump 16 so that the ink does not pass through the filter 57 in a state in which the opening/closing valve 15 is opened (step S2 in FIG. 8).

As a result of opening the opening/closing valve 15 and driving the pump 16, the ink is supplied from the intermediate tank 12 (not illustrated) to the upstream chamber 50A.

Since a pressure of the ink in this state does not exceed a bubble point of the filter 57, the ink does not pass through the filter 57.

Figure 5:
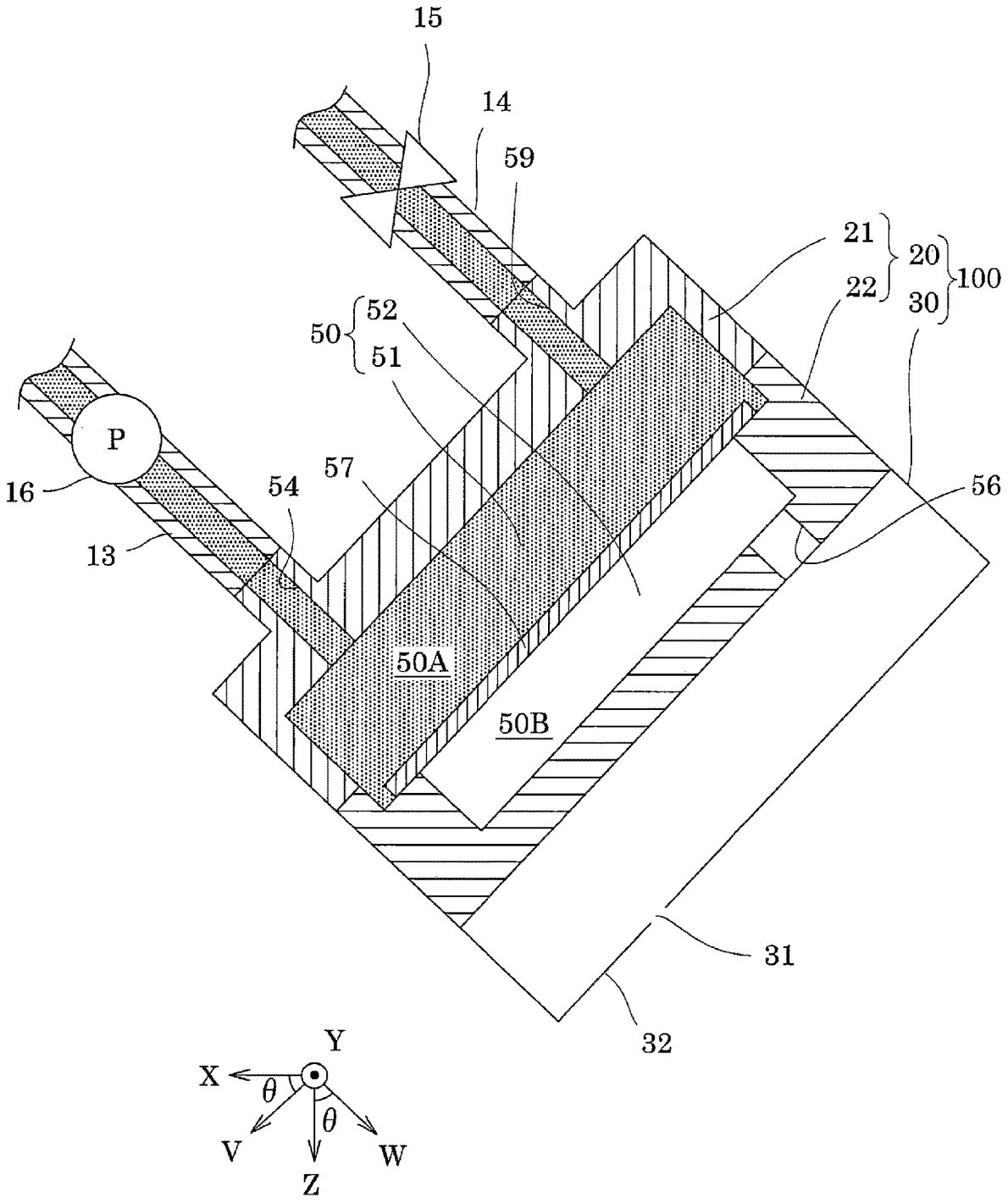
FIG. 5 is a cross-sectional view of the recording head when the filling operation according to the first embodiment is performed.

As illustrated in FIG. 5, the control portion 18 fills the upstream chamber 50A with the ink by driving the pump 16 (step S3 in FIG. 8). Strictly, the ink is filled from the upstream chamber 50A to the opening/closing valve 15 of the discharge path 14.

Specifically, the control portion 18 considers that the upstream chamber 50A has been filled with the ink when a predetermined time has elapsed after driving the pump 16. As such a predetermined time, it is sufficient to obtain a time enough for the upstream chamber 50A to be filled with the ink after driving the pump 16 by actual measurement, a simulation, or the like.

As another method, when the upstream chamber 50A has been filled with the ink after driving the pump 16, a pressure applied to the opening/closing valve 15 or a pressure of the ink pressurized by the pump 16 is obtained by measurement and set to a reference pressure. Then, the control portion 18 measures the pressure applied to the opening/closing valve 15 or the pressure of the ink pressurized by the pump 16, and considers that the upstream chamber 50A has been filled with the ink when such a pressure has reached the reference pressure.

As still another method, a sensor detecting that the ink has reached the opening/closing valve 15 may be provided, and the control portion 18 may consider that the upstream chamber 50A has been filled with the ink when the sensor has detected the ink. For example, a liquid level sensor or the like such as a capacitance type liquid level sensor or an ultrasonic liquid level sensor can be employed as such a sensor, but a type of the sensor is not particularly limited as long as the sensor can detect that the ink has reached the opening/closing valve 15.

The control portion 18 continues to drive the pump 16 even after the upstream chamber 50A has been filled with the ink, and the opening/closing valve 15 is in an opened state. Further, as described above, the flow path resistance of the filter 57 is larger than the entire flow path resistance of the discharge path 14. For this reason, the ink flows from the discharge port 59 to the discharge path 14 rather than passing through the filter 57. That is, the ink is flowing from the intermediate tank 12 toward the supply path 13, the upstream chamber 50A, and the discharge path 14 by the driving of the pump 16.

Figure 6:
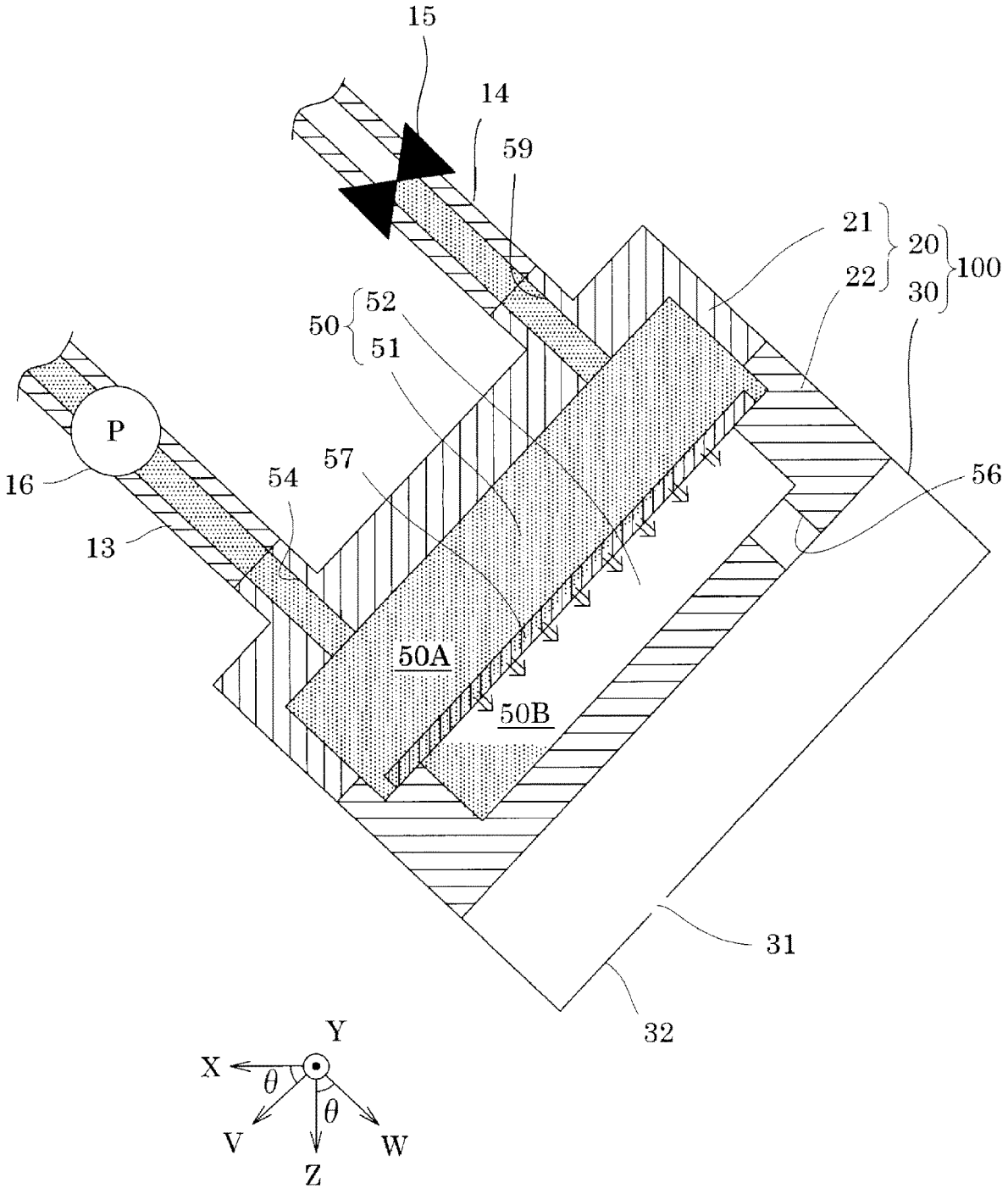
FIG. 6 is a cross-sectional view of the recording head when the filling operation according to the first embodiment is performed.

As illustrated in FIG. 6, the control portion 18 closes the opening/closing valve 15 while the ink is flowing from the intermediate tank 12 toward the supply path 13, the upstream chamber 50A, and the discharge path 14 by the driving of the pump 16 (step S4 in FIG. 8). It is sufficient that a timing when the opening/closing valve 15 is closed is any timing after the upstream chamber 50A has been filled with the ink.

The opening/closing valve 15 is closed in a state in which the ink has flowed by the control portion 18, such that a high pressure is generated in the upstream chamber 50A due to inertia of the ink flowing from the upstream chamber 50A toward the opening/closing valve 15. Due to this water hammer action, a pressure of the ink flowing through the upstream chamber 50A instantaneously rises to exceed the bubble point of the filter 57. Therefore, the ink passes through the filter 57 to flow into the downstream chamber 50B. Then, as illustrated in FIG. 7, the downstream chamber 50B is also filled with the ink, and the ink is supplied to the liquid ejecting portion 30 via the outlet 56.

Note that although not particularly illustrated, the control portion 18 stops the pump 16 and ends the filling operation, when the entire filter chamber 50 has been filled with the ink and a flow path of the ink up to the nozzle 31 of the recording head 100 has been filled with the ink. For example, when a predetermined time has elapsed since the pump 16 was driven or when it has been detected that the ink has been ejected from the nozzle 31 after the pump 16 was driven, the control portion 18 determines that the filter chamber 50 and the flow path of the ink up to the nozzle 31 of the recording head 100 has been filled with the ink, and stops the pump 16.

Figure 9:
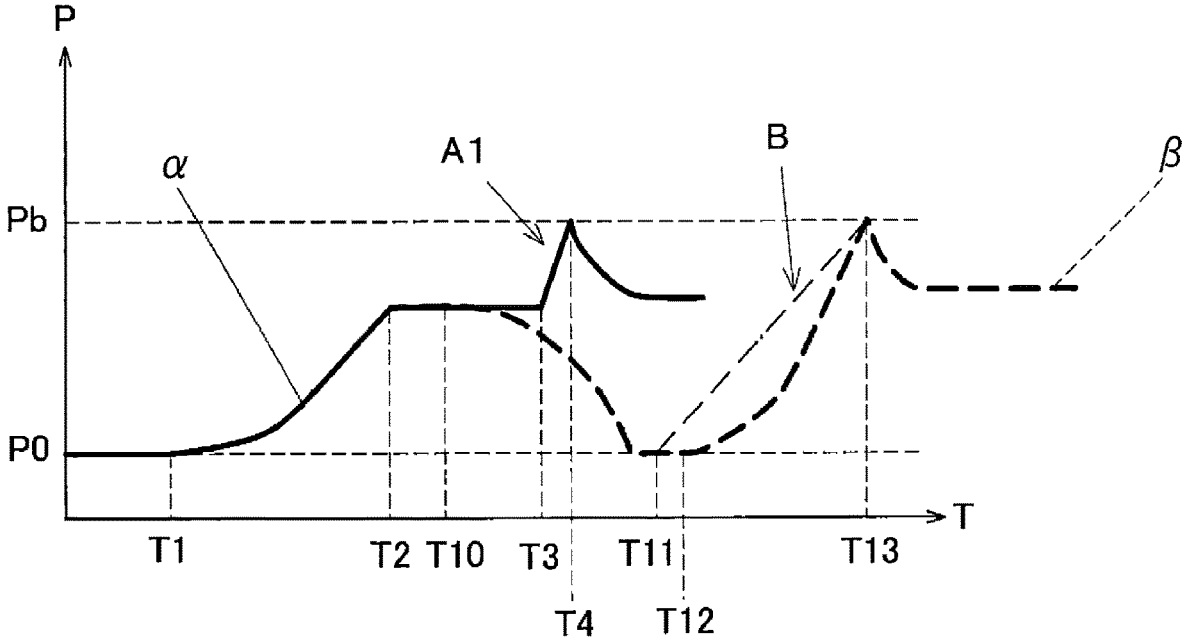
FIG. 9 is a diagram illustrating a change in pressure acting on a filter in the filling operation according to the first embodiment.

A change in pressure acting on the filter 57 by the ink will be described with reference to FIG. 9. FIG. 9 is a diagram illustrating a change in pressure acting on the filter in the filling operation. A vertical axis is a pressure P acting on the filter 57 by the ink, and a horizontal axis is a time T. A solid line α indicates a change in pressure acting on the filter 57 in the filling operation of the ink jet recording apparatus 1 described above. A dotted line β indicates a change in pressure acting on the filter when a filling operation as a comparative example different from the filling operation according to the present disclosure is performed.

As indicated by the solid line α, the control portion 18 drives the pump 16 at a time T1 corresponding to step S2 in the flowchart of FIG. 8. An amount of ink gradually increases in the upstream chamber 50A, and thus, the pressure P becomes higher than a pressure P0 before the pump 16 is driven.

At a time T2 corresponding to step S3 in the flowchart of FIG. 8, the upstream chamber 50A is filled with the ink by the control portion 18. In this state, the ink is flowing from the intermediate tank 12 toward the supply path 13, the upstream chamber 50A, and the discharge path 14 by the driving of the pump 16, and thus, the pressure P is constant until a time T3.

At the time T3 corresponding to step S4 in the flowchart of FIG. 8, the control portion 18 closes the opening/closing valve 15. As described above, the opening/closing valve 15 closes while the ink is flowing toward the supply path 13, the upstream chamber 50A, and the discharge path 14, and thus, the pressure P acting on the filter 57 by the ink instantaneously rises due to the water hammer action described above to reach a bubble point Pb.

After the time T3, the ink passes through the filter 57 to flow into the downstream chamber 50B, and thus, the pressure P decreases and is kept substantially constant thereafter.

As indicated by the dotted line β, the filling operation according to the comparative example is similar to that of the solid line α until the pump is driven at the time T1 and the upstream chamber 50A is filled with the ink at the time T2. In the filling operation according to the comparative example, the pump is stopped at a time T10 after the time T2. For this reason, a flow of the ink from the intermediate tank 12 toward the supply path 13, the upstream chamber 50A, and the discharge path 14 gradually disappears. As the flow of the ink stops, the pressure P of the ink acting on the filter 57 gradually decreases to become the pressure P0 before the pump 16 is driven.

In the filling operation according to the comparative example, the opening/closing valve 15 is closed at a subsequent time T11, and the pump 16 is driven at a time T12. By such an operation, the pressure P of the ink acting on the filter 57 increases to reach the bubble point Pb at a time T13. After the time T13, the ink passes through the filter 57 to flow into the downstream chamber 50B, and thus, the pressure P decreases and is kept substantially constant thereafter.

Further, as indicated by the solid line α, an average rate of change in the pressure of the ink acting on the filter 57 over time from a time when the opening/closing valve 15 is closed at the time T3 to a time T4 when the ink passes through the filter 57 is defined as an inclination A1. Further, as indicated by the solid line β, an average rate of change in the pressure of the ink acting on the filter 57 over time from a time when the opening/closing valve 15 is closed at the time T11 to the time T13 when the ink passes through the filter 57 is defined as an inclination B. The inclination A1 is larger than the inclination B.

In the ink jet recording apparatus 1 and the filling method of the recording head 100 described above, the ink is made to flow from the intermediate tank 12 to the supply path 13, the upstream chamber 50A, and the discharge path 14 by continuing to drive the pump 16 even after the upstream chamber 50A has been filled with the ink, as illustrated in FIG. 5. Due to such a flow of the ink, bubbles remaining in the upstream chamber 50A can be discharged to the discharge path 14 together with the ink. Then, the pressure of the ink applied to the filter 57 is instantaneously raised due to the water hammer action by closing the opening/closing valve 15 in a state in which the ink is flowing, as illustrated in FIG. 6. As a result, bubbles existing in the filter 57 can be made to flow from the downstream chamber 50B to the recording head 100 at once together with the ink, such that a possibility that fine bubbles will remain between the filter 57 and the nozzle 31 can be reduced.

Further, with respect to the solid line α in FIG. 9, the pressure is raised by the driving of the pump 16 from the time T1 to the time T2, but the pressure of the ink reaches the bubble point Pb by closing the opening/closing valve 15 at the time T3. In other words, the pressure of the ink is raised using not only the driving of the pump 16 but also the water hammer action.

On the other hand, with respect to the dotted line β, which is the comparative example, the pressure is raised by the pump 16 from the time T1 to the time T2. However, since the pump 16 is stopped at the time T10, the pressure of the ink returns to the original pressure P0 when the opening/closing valve 15 is closed at the time T11. In this state, the pump 16 is driven at the time T12, and the pressure of the ink is raised only by the driving of the pump 16 until the pressure of the ink reaches the bubble point Pb.

As described above, the filling operation according to the comparative example utilizes only the pump 16, while the filling operation according to the present embodiment utilizes not only the pump 16 but also the water hammer action. Therefore, in order to make the pressure of the ink the bubble point Pb, in the ink jet recording apparatus 1 according to the present embodiment, the pump 16 having a maximum output smaller than a maximum output of the pump used in the filling operation according to the comparative example can be used. As a result, energy consumed by the pump 16 can be reduced, and the pump 16 can be miniaturized.

In addition, as illustrated in FIG. 9, the inclination A1 in the filling operation according to the present embodiment is larger than the inclination B in the filling operation according to the comparative example. This means that in the filling operation according to the present embodiment, after the opening/closing valve 15 is closed at the time T3, the pressure of the ink can be raised in a short time as compared with the filling operation according to the comparative example. Since the pressure of the ink can be raised in the short time as described above, a driving time of the pump 16 can be shortened. As a result, a life of the pump 16 can be extended, and an amount of the ink discharged from the nozzle 31 at the time of the filling operation can be reduced. In addition, since the amount of the ink can be reduced, the intermediate tank 12 in which the ink pressurized by the pump 16 is stored can be miniaturized.

Second Embodiment

Figure 10:
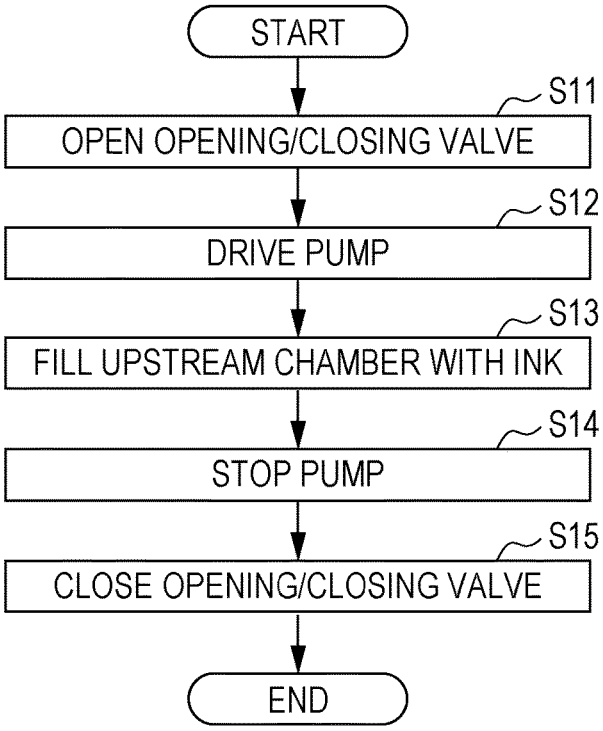
FIG. 10 is a flowchart of a filling operation according to a second embodiment.
Figure 11:
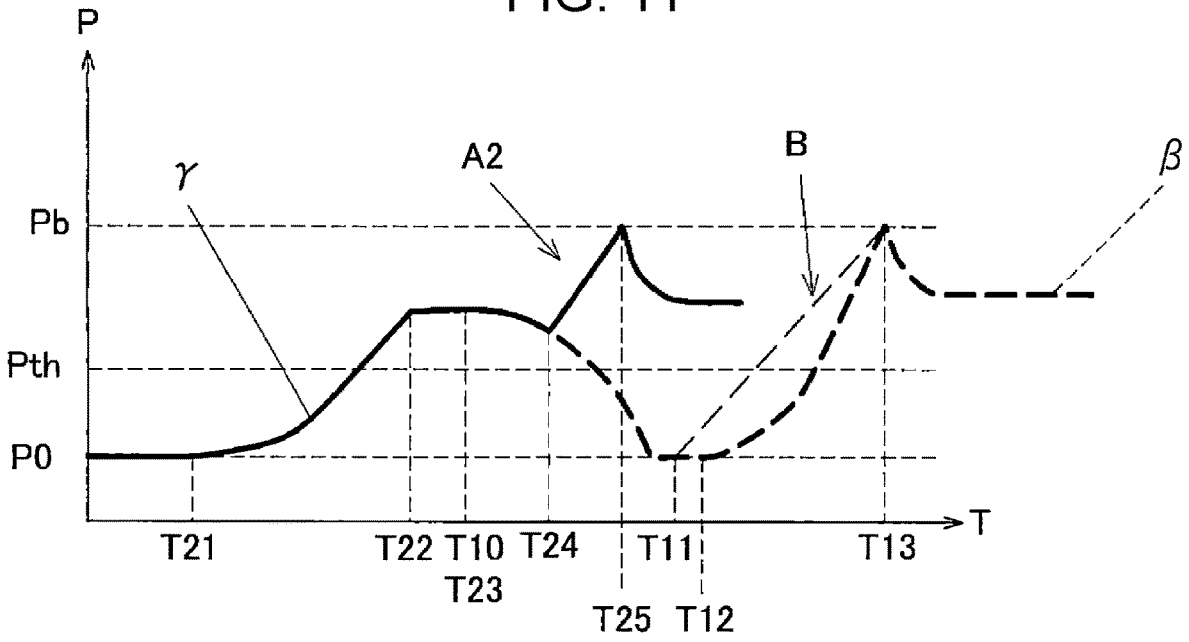
FIG. 11 is a diagram illustrating a change in pressure acting on a filter in the filling operation according to the second embodiment.

An ink jet recording apparatus 1 according to a second embodiment will be described with reference to FIGS. 10 and 11. FIG. 10 is a flowchart of a filling operation, and FIG. 11 is a diagram illustrating a change in pressure acting on a filter 57. A solid line γ in FIG. 11 indicates a change in pressure acting on the filter 57 in the filling operation of the ink jet recording apparatus 1 according to the present embodiment. Note that the same members as those in the first embodiment are denoted by the same reference numerals, and an overlapping description will be omitted.

First, the control portion 18 opens the opening/closing valve 15 (step S11 in FIG. 10), and drives the pump 16 so that the ink does not pass through the filter 57 in a state in which the opening/closing valve 15 is opened (step S12 in FIG. 10). Then, the control portion 18 fills the upstream chamber 50A with the ink (step S13 in FIG. 10). These steps S11 to S13 are the same as steps S1 to S3 of the first embodiment, and a detailed description thereof will thus be omitted.

Next, the control portion 18 stops the pump 16 (step S14 in FIG. 10). A timing when the pump 16 is stopped is not particularly limited.

The opening/closing valve 15 is opened by the control portion 18, and as described in the first embodiment, a flow path resistance of the filter 57 is larger than an entire flow path resistance of the discharge path 14. For this reason, even though the control portion 18 stops the pump 16 after the upstream chamber 50A has been filled with the ink, a flow of the ink from the intermediate tank 12 toward the supply path 13, the upstream chamber 50A, and the discharge path 14 continues for a while.

Next, the control portion 18 closes the opening/closing valve 15 while the ink is flowing from the intermediate tank 12 toward the supply path 13, the upstream chamber 50A, and the discharge path 14 by the driving of the pump 16 (step S15 in FIG. 10). "While the ink is flowing by the driving of the pump 16" mentioned in the present disclosure includes not only a case where the ink flows in a state in which the pump 16 is being driven as in the first embodiment, but also a state in which the ink flows by the driving of the pump 16 and then, the ink is flowing after the pump 16 is stopped as in the second embodiment.

Further, as indicated by the solid line γ in FIG. 11, a time T24 when the opening/closing valve 15 is closed is when a pressure P of the ink is equal to or higher than a pressure Pth, which is a threshold. The pressure Pth is set so that the pressure P after closing the opening/closing valve 15 exceeds the bubble point Pb.

The opening/closing valve 15 is closed in a state in which the ink is flowing by the control portion 18, such that a pressure of the ink flowing through the upstream chamber 50A instantaneously rises due to a water hammer action to exceed the bubble point of the filter 57, similar to the first embodiment. Therefore, the ink passes through the filter 57 to flow into the downstream chamber 50B. Then, the downstream chamber 50B is also filled with the ink, and the ink is supplied to the liquid ejecting portion 30 via the outlet 56.

A change in pressure acting on the filter 57 by the ink will be described with reference to FIG. 11. As indicated by the solid line γ, at a time T21, the control portion 18 drives the pump 16. An amount of ink gradually increases in the upstream chamber 50A, and thus, the pressure P becomes higher than a pressure P0 before the pump 16 is driven.

At a time T22, the upstream chamber 50A is filled with the ink by the control portion 18. In this state, the ink is flowing from the intermediate tank 12 toward the supply path 13, the upstream chamber 50A, and the discharge path 14 by the driving of the pump 16, and thus, the pressure P is constant until a time T23.

At the time T23, the control portion 18 stops the pump 16. By stopping the pump 16, the ink flow continues, but the pressure P is gradually lowered.

At the time T24, the control portion 18 closes the opening/closing valve 15. As described above, even after the pump 16 is stopped, the ink is flowing toward the supply path 13, the upstream chamber 50A, and the discharge path 14. Therefore, the opening/closing valve 15 is closed while the ink is flowing, similar to the first embodiment, and thus, the pressure P acting on the filter 57 by the ink instantaneously rises due to the water hammer action to reach the bubble point Pb.

After a time T25, the ink passes through the filter 57 to flow into the downstream chamber 50B, and thus, the pressure P decreases and is kept substantially constant thereafter.

Further, as indicated by the solid line γ, an average rate of change in the pressure of the ink acting on the filter 57 over time from a time when the opening/closing valve 15 is closed at the time T24 to the time T25 when the ink passes through the filter 57 is defined as an inclination A2. The inclination A2 is larger than the inclination B. Note that the inclination A1 is larger than the inclination A2.

In the ink jet recording apparatus 1 and the filling method of the recording head 100 described above, the ink is made to flow from the intermediate tank 12 to the supply path 13, the upstream chamber 50A, and the discharge path 14 by continuing to drive the pump 16 from the time T22 when the upstream chamber 50A has been filled with the ink to the time T23. Due to such a flow of the ink, bubbles remaining in the upstream chamber 50A can be discharged to the discharge path 14 together with the ink.

After the upstream chamber 50A has been filled with the ink at time the T22, the pump 16 is stopped at the time T23. The pump 16 is stopped as described above, but the opening/closing valve 15 is closed while a flow of the ink from the intermediate tank 12 toward the supply path 13, the upstream chamber 50A, and the discharge path 14 continues by the driving of the pump 16. As a result, the pressure of the ink applied to the filter 57 can be instantaneously raised due to the water hammer action. Then, bubbles existing in the filter 57 can be made to flow from the downstream chamber 50B to the recording head 100 at once together with the ink, such that a possibility that fine bubbles will remain between the filter 57 and the nozzle 31 can be reduced.

Further, similar to the first embodiment, in the filling operation according to the present embodiment, a maximum output required for the pump 16 may be lower than that of the filling operation according to the comparative example. Therefore, in the ink jet recording apparatus 1 of the present embodiment, the filling operation can be performed even though the maximum output of the pump 16 is small, such that the pump 16 can be miniaturized.

In addition, the inclination A2 in the filling operation according to the present embodiment is larger than the inclination B in the filling operation according to the comparative example. Therefore, an effect similar to that of the first embodiment is achieved. That is, since the pressure of the ink can be raised in a short time, a driving time of the pump 16 can be shortened. As a result, a life of the pump 16 can be extended, and an amount of the ink discharged from the nozzle 31 at the time of the filling operation can be reduced. In addition, since the amount of the ink can be reduced, the intermediate tank 12 in which the ink pressurized by the pump 16 is stored can be miniaturized.

Third Embodiment

Figure 12:
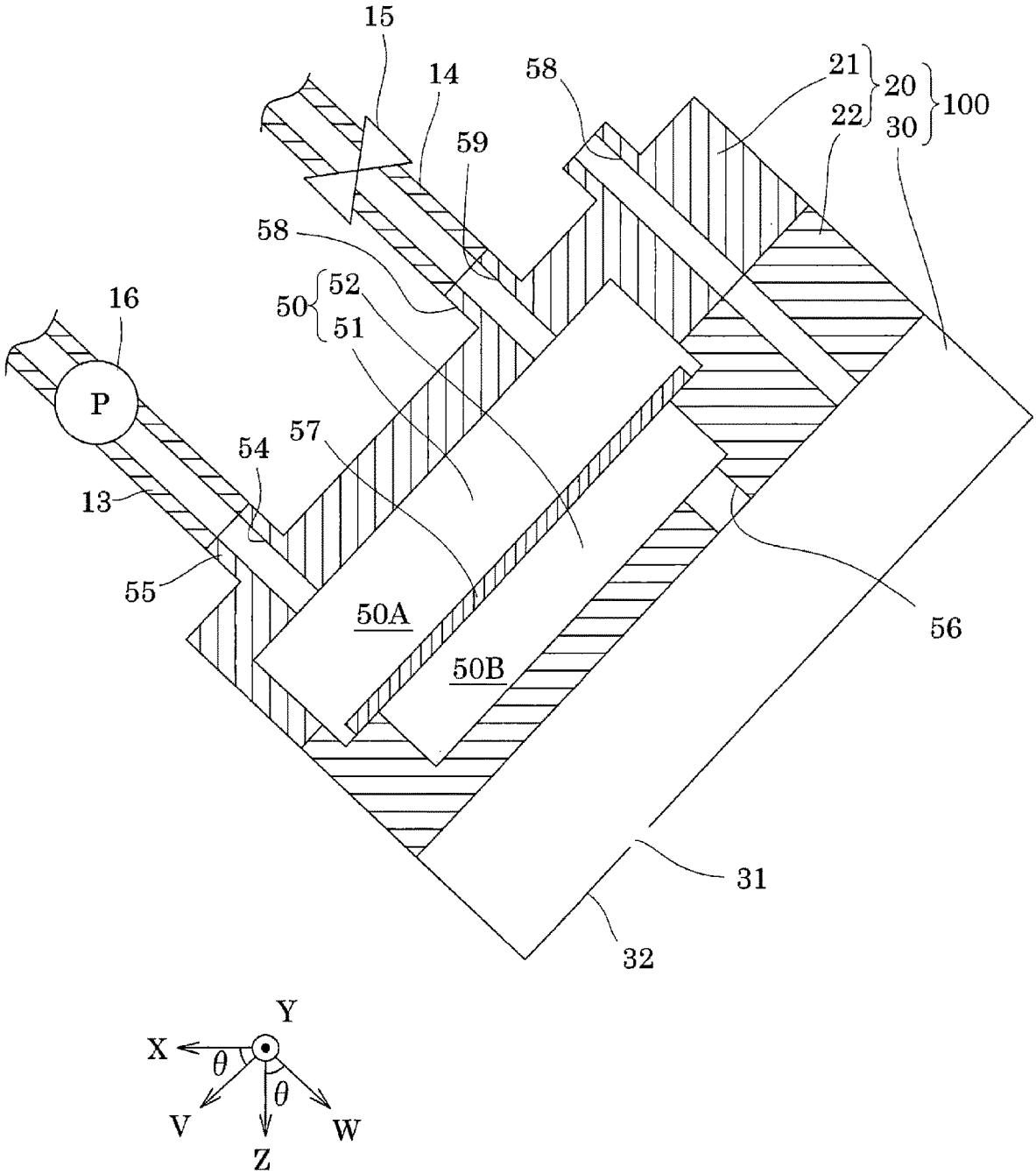
FIG. 12 is a cross-sectional view of a recording head according to a third embodiment.

An ink jet recording apparatus 1 according to a third embodiment will be described with reference to FIG. 12. FIG. 12 is a cross-sectional view of a recording head, and illustrates a recording head 100 in a state in which the recording head 100 is arranged so that an ejection direction of ink is a +W direction, similar to FIG. 1. Note that the same members as those in the first embodiment are denoted by the same reference numerals, and an overlapping description will be omitted.

In the recording head 100 according to the present embodiment, the filter member 20 is provided with a discharge path 58 under a filter. The discharge path 58 under a filter is a flow path for returning ink in the downstream chamber 50B on a downstream of the filter 57 to the intermediate tank 12 via the liquid ejecting portion 30. In the present embodiment, one opening of the discharge path 58 under a filter is coupled to the liquid ejecting portion 30, and the other opening of the discharge path 58 under a filter is coupled to the intermediate tank 12 by a flow path (not illustrated).

In such a recording head 100, the ink is supplied from the downstream chamber 50B to the liquid ejecting portion 30, and the ink that has not been ejected from the nozzle 31 is returned from the liquid ejecting portion 30 to the intermediate tank 12 via the discharge path 58 under a filter.

In the ink jet recording apparatus 1 described above, a filling operation similar to that of the first embodiment is performed, and an action and effect similar to that of the first embodiment is achieved. In addition, in such an ink jet recording apparatus 1, even minute bubbles in the liquid ejecting portion 30 that could not be completely removed from the liquid ejecting portion 30 by the filling operation can be discharged from the discharge path 58 under a filter via a flow path inside the liquid ejecting portion 30. For this reason, even though minute bubbles flow into and remain in the downstream chamber 50B due to the filling operation, it is possible to prevent the bubbles from reaching the nozzle 31 to reduce an ejection defect due to the bubbles. Note that the discharge path 58 under a filter may be formed in a member different from the filter member 20.

OTHER EMBODIMENTS

An embodiment of the present disclosure has been described hereinabove, but a basic configuration of the present disclosure is not limited to that described above.

The intermediate tank 12 has been used as the liquid storage portion in the above-described embodiment, but the present disclosure is not limited thereto. For example, the main tank 11 may be used as the liquid storage portion, and the main tank 11 and the upstream chamber 50A may be coupled to each other by the supply path 13 and the discharge path 14.

The supply path 13 and the discharge path 14 have been directly coupled to the upstream chamber 50A of the filter member 20 in the above-described embodiment, but the present disclosure is not limited thereto. For example, the holding portion 101 may be provided with a flow path for supplying the ink to the filter chamber 50, and the supply path 13 and the discharge path 14 may be coupled to the upstream chamber 50A via the flow path. In addition, instead of the holding portion 101, a flow path member supplying the ink to the filter chamber 50 may be provided, and the supply path 13 and the discharge path 14 may be coupled to the upstream chamber 50A via the flow path member.

A so-called line-type recording apparatus in which the line head 2 including the recording head 100 is fixed to the holding portion 101 and printing is performed only by transporting the medium S has been exemplified as the ink jet recording apparatus 1 in the above-described embodiment, but the present disclosure is not particularly limited thereto. The present disclosure can also be applied to a so-called serial type recording apparatus in which the recording head 100 is mounted on a carriage that moves in a direction intersecting the transport direction of the medium S and printing is performed while the recording head 100 reciprocates in the direction intersecting the transport direction. In the serial type recording apparatus, the carriage inclines and holds the recording head 100 so that a direction in which the ink is ejected is a direction inclined with respect to the +Z direction. Then, a reciprocating direction of the carriage is the Y direction. Even in such a serial type recording apparatus, an action and effect similar to that in the first to third embodiments is achieved.

In addition, the present disclosure is widely intended for all of liquid ejecting heads, and can also be applied to, for example, recording heads such as various ink jet recording heads used in image recording apparatuses such as printers, color material ejecting heads used for manufacturing color filters of liquid crystal displays or the like, electrode material ejecting heads used for forming electrodes of organic electro luminescence (EL) displays, field emission displays (FEDs), or the like, bioorganic material ejecting heads used for manufacturing biochips, and the like. Of course, the liquid ejecting apparatus equipped with such a liquid ejecting head is not particularly limited.

What is claimed is:

1. A filling method of a liquid ejecting head including: a liquid ejecting portion configured to eject a liquid; a liquid storage portion storing the liquid; a filter chamber including an upstream chamber and a downstream chamber divided by a filter through which the liquid passes; a supply path through which the liquid flows from the liquid storage portion to the upstream chamber; a discharge path through which the liquid flows from the upstream chamber to the liquid storage portion; an opening/closing valve opening/closing the discharge path; and a pressurizing mechanism pressurizing the liquid in order to make the liquid flow from the liquid storage portion to the upstream chamber, the filling method of a liquid ejecting head comprising:

performing a filling operation of filling the upstream chamber with the liquid by driving the pressurizing mechanism so that the liquid does not pass through the filter in a state in which the opening/closing valve is opened, and then closing the opening/closing valve while the liquid is flowing from the liquid storage portion toward the supply path, the upstream chamber, and the discharge path by the driving of the pressurizing mechanism.

2. The filling method of a liquid ejecting head according to claim 1, wherein in the filling operation, after the upstream chamber has been filled with the liquid, the opening/closing valve is closed in a state in which the pressurizing mechanism is being driven.

3. The filling method of a liquid ejecting head according to claim 1, wherein in the filling operation, after the upstream chamber has been filled with the liquid, the pressurizing mechanism is stopped, and the opening/closing valve is then closed.

4. The filling method of a liquid ejecting head according to claim 1, wherein an average rate of change in pressure of the liquid acting on the filter over time from a time when the opening/closing valve is closed until the liquid passes through the filter in the filling operation is larger than an average rate of change in pressure of the liquid acting on the filter over time from a time when the pressurizing mechanism is driven in a state in which the opening/closing valve is closed until the liquid passes through the filter.

* * * * *